US005729985A

United States Patent [19]

Yoshihara et al.

[11] Patent Number: 5,729,985

[45] Date of Patent: Mar. 24, 1998

[54] AIR CONDITIONING APPARATUS AND METHOD FOR AIR CONDITIONING

[75] Inventors: Hirofumi Yoshihara; Hideyuki Oohashi; Katsuyuki Nagura, all of Iwata, Japan

[73] Assignee: Yamaha Hatsudoki Kabushiki Kaisha, Iwata, Japan

[21] Appl. No.: 578,866

[22] Filed: Dec. 27, 1995

[30] Foreign Application Priority Data

Dec. 28, 1994 [JP] Japan ..... 6-328662

[51] Int. Cl.[6] ..... F25B 47/02

[52] U.S. Cl. ..... 62/81; 62/238.7; 62/278; 62/324.5

[58] Field of Search ..... 62/160, 277, 278, 62/81, 324.5, 323.1, 238.6, 238.7

[56] References Cited

U.S. PATENT DOCUMENTS 4,754,614 7/1988 Yuyama ..... 62/238.6
4,766,734 8/1988 Dudley ..... 62/278 X
5,099,651 3/1992 Fischer ..... 62/323.1 X
5,174,123 12/1992 Erickson ..... 62/278 X
5,228,301 7/1993 Sjoholm et al. ..... 62/324.5 X

*Primary Examiner*—Harry B. Tanner
*Attorney, Agent, or Firm*—Knobbe, Martens, Olson & BearLLP

[57] ABSTRACT

An air conditioning apparatus for heating and cooling a room, which has a four-way valve to reverse the flow of a refrigerant, thereby switching the operation mode, heating or cooling, and which has a bypass line for bypassing an inside heat-exchanger, a control valve for controlling the flow ratio of the refrigerant passing through the bypass line and the inside heat-exchanger, and a refrigerant-heating element disposed in a line between the control valve and the compressor, thereby, in the defrosting mode, melting the frost formed on endothermic fins without cooling the room and without a liquid return to the suction side of the compressor.

20 Claims, 4 Drawing Sheets

AIR CONDITIONING APPARATUS AND METHOD FOR AIR CONDITIONING

BACKGROUND

1. Field of the Invention

This invention relates to an air conditioning apparatus, for heating or cooling the air in a room, comprising an inside heat-exchanger installed in the room and an outside heat-exchanger installed outside the room, and, in particular, to such an apparatus provided with a defrosting system which allows for defrosting the outside heat-exchanger without substantially cooling the air in the room. In addition, this invention relates to a method for air conditioning a room, in which the outside heat-exchanger is defrosted without substantially cooling the air in the room.

2. Background of the Art

An air conditioning apparatus for heating or cooling the air in a room, comprises, in a refrigerant circulation line in which a refrigerant circulates, a compressor for circulating the refrigerant in the line, a four-way valve for reversing the flow of the refrigerant, an inside heat-exchanger for exchanging heat between the refrigerant and the air in the room, an expansion valve arranged in series with the inside heat-exchanger, and an outside heat-exchanger for exchanging heat between the refrigerant and the air outside the room. When heating the room, i.e., in a heating modes the refrigerant circulates in the refrigerant circulation line in the order of the compressor, the four-way valved the inside heat-exchanger functioning as a condenser, the expansion valve, and the outside heat-exchanger functioning as an evaporator. When cooling the room, i.e., in a cooling mode, the refrigerant circulates in the refrigerant circulation line in the order of the compressor, the four-way valve, the outside heat-exchanger functioning as a condenser, the expansion valve, and the inside heat-exchanger functioning as an evaporator.

A basic cycle in the heating mode of an engine-driven air conditioning apparatus will be explained using a p-i chart shown in FIG. 4.

When a compressor is driven by an engine, a vaporized refrigerant in a state (pressure $P_1$ and enthalpy $i_1$) marked (1) in FIG. 4 is compressed with the compressor and changed to a state (pressure $P_2$ and enthalpy $i_2$) marked (2) in FIG. 4, in which the refrigerant has a high temperature and is under a high pressure. The power of the compressor necessary to cause the change per unit weight of the refrigerant (the quantity of heat for compression), AL, is expressed as $(i_2-i_1)$.

The refrigerant with a high temperature and under a high pressure is introduced to an inside heat-exchanger functioning as a condenser, and liquefied therein as a result of radiating heat of condensation $Q_2$ to the air in a room. The liquefied refrigerant after passing through the inside heat-exchanger is in a state (pressure $P_2$ and enthalpy $i_3$) marked (3) in FIG. 4, in which the refrigerant is sub-cooled by $\Delta i_c$ as a result of heat radiation $Q_2$ (i.e., $i_2-i_3$) which heats the interior of the room. The sub-cooling is achieved by enlarging the area for heat radiation or setting the r.p.m. of a blowing fan to increase the air flow passing through the area for heat radiation.

The liquefied refrigerant in a state marked (3) subsequently undergoes reduction of pressure due to an expansion valve, and is changed to a state (pressure $P_1$ and enthalpy $i_3$) marked (4) in FIG. 4, in which part of the refrigerant is vaporized. The partially vaporized refrigerant is then introduced to an outside heat-exchanger functioning as an evaporator. The partially vaporized refrigerant receives heat from the outside air at the outside heat-exchanger and vaporizes, in which process the refrigerant is superheated and returns to a state (pressure $p_1$ and enthalpy $i_1$) marked (1) in FIG. 4. After this the same operation as above is repeated. In the above, the quantity of heat $Q_1$ the refrigerant receives at the outside heat-exchanger is expressed as $(i_1-i_3)$. The superheating is achieved by enlarging the conductive area of heat or setting the r.p.m. of a blowing fan to increase the air flow passing through the conductive area of heat.

When the air conditioning apparatus is running in a heating mode, moisture in the air often forms frost on endothermic fins of the outside heat-exchanger, causing the pressure of the refrigerant to drastically fall after passing through the expansion valve, and the refrigerant to evaporate and cool the fins, thereby absorbing heat from the air. When the fins are frosted, the heat-exchange efficiency of the outside heat-exchanger, i.e., an evaporator, will be abated due to the low heat transfer value of frost. In such a case, the air conditioning apparatus temporarily runs in a cooling mode by reversing the flow of the refrigerant, i.e., a reversing type of defrosting, in order to drive the outside heat-exchanger as a condenser, thereby radiating heat from the fins of the outside heat exchanger, and melting the frost.

The reversing type of defrosting, however, has a drawback in that cool air comes out from the inside heat exchanger into a room to be heated during the defrost mode because the inside heat exchanger is driven as an evaporator. Since the air in the room should be heated, a current of cool air is uncomfortable.

A typically conceivable countermeasure to cope with the above drawback is to discontinue operation of a fan for generating a current of air installed in the inside heat exchanger, so that cool air will not come out from the inside heat exchanger. However, when the fan is stopped, the refrigerant will not completely evaporate while passing through the inside heat-exchanger, i.e., an evaporators due to insufficient heat exchange. If the refrigerant containing a liquid portion is introduced to the suction side of a compressor, i.e., a liquid return, a breakdown of the compressor may occur. Thus, hitherto, in the reversing type defrosting, it was not practicable to defrost the outside heat-exchanger without cooling the air inside a room which should be heated.

SUMMARY OF THE INVENTION

The present invention has exploited an air conditioning apparatus for heating and cooling with a defrosting function of reversing type. An objective of the present invention is to provide an air conditioning apparatus and a method for air conditioning which allow for defrosting the outside heat-exchanger without generating cool air inside a room to be heated and without causing a liquid return to the suction side of a compressor.

Namely, one important aspect of the present invention is an air conditioning apparatus comprising a refrigerant circulation line in which a refrigerant circulates, said refrigerant circulation line comprising: a compressor for circulating said refrigerant; an inside heat-exchanger for exchanging heat between said refrigerant and the air inside a room; an outside heat-exchanger for exchanging heat between said refrigerant and the air outside said room; an expansion valve; and a four-way valve for reversing the flow of said refrigerant at said inside heat-exchanger and at said outside heat-exchanger, wherein said apparatus further comprises: a bypass line for bypassing said inside heat-exchanger, said bypass line being disposed in parallel to said inside heat-exchanger; at least one control valve for controlling the flow ratio of the refrigerant flowing through said inside heat-exchanger and the refrigerant flowing through said bypass line; and a refrigerant-heating element being disposed in said bypass line and/or in a line downstream of said bypass line and upstream of said compressor when in the defrosting mode. According to the above apparatus, in the defrosting mode wherein the apparatus is temporarily driven for cooling the inside heat-exchanger, i.e., for heating the outside heat-exchanger, it is possible to avoid generating cool air in the room to be heated and eliminate discomfort to occupants, by guiding the liquefied refrigerant after passing through the outside heat-exchanger (a condenser) so as to flow into the bypass line by partially or entirely bypassing the inside heat-exchanger. Further, the refrigerant, which contains a liquid portion, is under a low pressure with a low temperature after passing through the expansion valve, is heated in the refrigerant-heating element so as to completely evaporate the refrigerant, thereby avoiding a liquid return to the suction side of the compressor, and eliminating a cause of a breakdown of the compressor.

In the above apparatus, said at least one control valve can comprised of a second expansion valve provided in said bypass line, or when said bypass line is provided downstream of said expansion valve when in the defrosting mode, said at least one control valve can be comprised of one or two on-off valve(s) provided in series with said inside heat-exchanger and/or in said bypass line. Further, when said bypass line is provided downstream of said expansion valve when in the defrosting mode, said at least one control valve can be comprised of a three-way valve provided at the point of divergence of said bypass line and said inside heat-exchanger when in the defrosting mode.

In the above apparatus, if the first expansion valve or the second expansion valve is of linear type, the flow ratio of the refrigerant passing through the first expansion valve and that passing through the second expansion valve can be linearly adjusted.

The compressor is preferably an engine-driven compressors and the refrigerant-heating element is preferably an accumulator or a heat-exchanger of double-tube type through which a cooling water for cooling the engine and the refrigerant separately flow, in which heat from the cooling water is transmitted to the refrigerant, thereby efficiently and economically using heat generated from the engine, which was hitherto wasted. Further; when the engine is provided with a water jacket and a muffler, in which the cooling water flows through the water jacket and the muffler to absorb heat therefrom; heat can be efficiently used. When the cooling water is not warm enough, it bypasses the refrigerant-heating element and circulates through a radiator arranged in parallel to the refrigerant-heating element. Alternatively, the compressor can be an electrically-driven compressor, and the refrigerant-heating element can be comprised of an electric heater.

In the aforesaid apparatus, the refrigerant-heating element is preferably disposed in a line between the four-way valve and a low pressure inlet of the compressor, or in a line upstream of the at least one control valve and downstream of the four-way valve when in the defrosting mode.

Another important aspect of the present invention is to provide a method for air-conditioning comprising the steps of:

circulating a refrigerant, for heating or cooling the air in a room, in a refrigerant circulation line comprising: a compressor; an inside heat-exchanger for exchanging heat between said refrigerant and the air inside said room; an outside heat-exchanger for exchanging heat between said refrigerant and the air outside said room; an expansion valve; and a four-way valve for reversing the flow of said refrigerant at said inside heat-exchanger and at said outside heat-exchanger, wherein said refrigerant flows from said inside heat-exchanger to said outside heat-exchanger through said expansion valve for heating the air inside said room, and said refrigerant flows from said outside heat-exchanger to said inside heat-exchanger through said expansion valve for cooling the air inside said room; and when defrosting said outside heat-exchanger, setting with said four-way valve the flow of said refrigerant in the direction from said outside heat-exchanger to said inside heat-exchanger through said expansion valve; bypassing said inside heat-exchanger by circulating at least part of said refrigerant in a bypass line arranged in parallel to said inside heat-exchanger; and heating said refrigerant upstream of said compressor and downstream of said expansion valve when the refrigerant flows for defrosting, thereby defrosting said outside heat-exchanger substantially without cooling the air inside said room. In the step of bypassing the inside heat-exchanger, at least one control valve to control the flow ratio of the refrigerant passing through said inside heat-exchanger and the refrigerant passing through said bypass line is preferably used. According to the above method, as described above in connection with the air conditioning apparatus, in the defrosting mode wherein the apparatus is temporarily driven for cooling the inside heat-exchanger, i.e., for heating the outside heat-exchanger, it is possible to avoid generating cool air in the room to be heated and eliminate discomfort to occupants, by guiding the liquefied refrigerant after passing through the outside heat-exchanger (a condenser) so as to flow into the bypass line by partially or entirely bypassing the inside heat-exchanger. Further, the refrigerant, which contains a liquid portion, is under a low pressure with a low temperature after passing through the bypass line, is heated so as to completely evaporate the refrigerant, thereby avoiding a liquid return to the suction side of the compressor, and eliminating a cause of a breakdown of the compressor. The ratio of refrigerant passing through the bypass line to that passing through the expansion valve is adjusted so as to satisfy the following conditions: (a) cool air is not generated in a room to an uncomfortable level; and (b) the amount of the vaporized refrigerant is sufficient to operate the apparatus (the liquefied refringent does not flow into the compressor). Depending on the quantity of heat exerted on the refrigerant, part of the refrigerant may be introduced to the expansion valve and the inside heat-exchanger: otherwise, liquid refrigerant remains and causes a breakdown of the compressor. The flow ratio of the refrigerant passing through said inside heat-exchanger and the refrigerant passing through said bypass line is controlled by manipulating the control valve(s), e.g., a second expansion valve provided in the bypass line, two on-off valves, one provided in series with the inside heat-exchanger, the other provided in the bypass line provided downstream of the expansion valve when in the defrosting mode, or a three-way valve provided at the point of divergence of the inside heat-exchanger and the bypass line provided downstream of the expansion valve when in the defrosting mode.

In the above method, the embodiments recited in the aforesaid air conditioning apparatus can be employed to obtain the same advantages.

DETAILED DESCRIPTION OF THE PREFERRED EMBODIMENT

In the present invention; in a defrosting mode, at least part of the refrigerant circulates through the second expansion valve and the refrigerant-heating element, thereby avoiding cooling the air in the room and avoiding a liquid return to the low pressure side of the compressor. The present invention will be further explained based on FIG. 1.

Basic System (Engine-driven Compressor Type)

Figure 1:
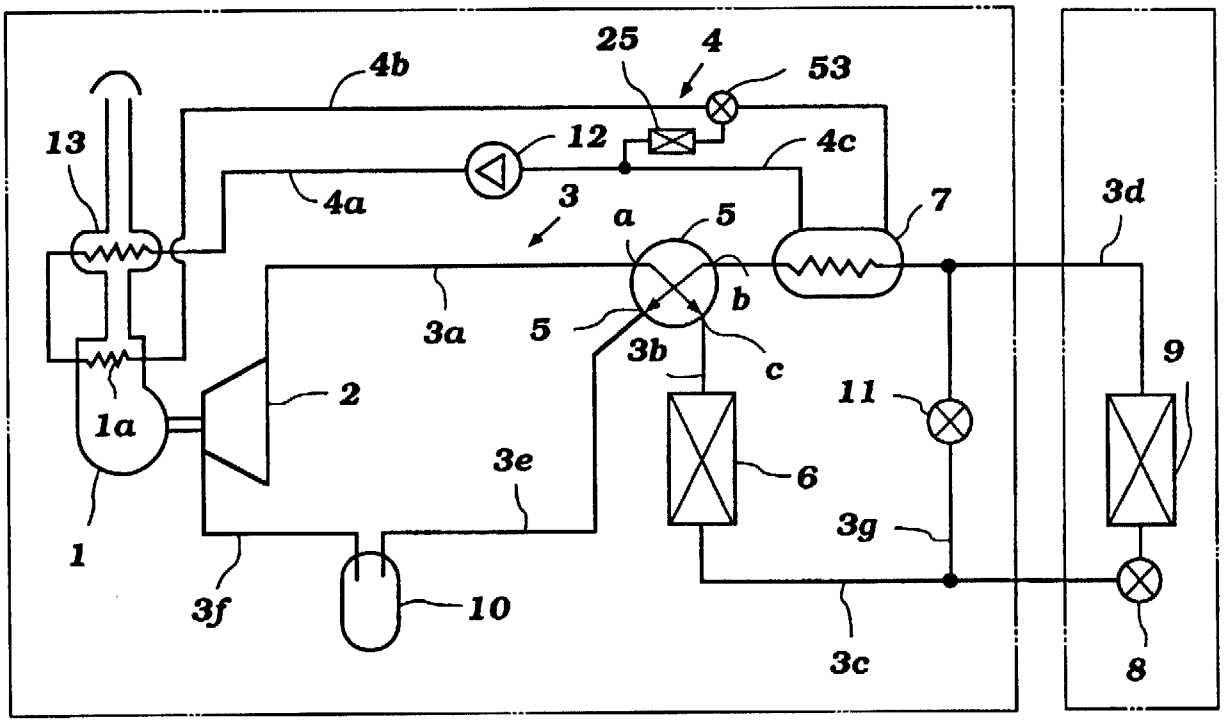
FIG. 1 is a schematic circuit illustrating basic structures of an engine-driven air conditioning apparatus according to an embodiment of the present invention.

FIG. 1 is a schematic circuit illustrating basic structures of an engine-driven air conditioning apparatus according to an embodiment of the present invention. The air conditioning apparatus depicted in FIG. 1 is provided with a water-cooled engine 1 and a compressor 2 driven by the engine, and comprises a refrigerant circulation line 3 in which the refrigerant circulates in a closed loop including the compressor 2, and a cooling water line 4 in which cooling water for cooling the engine 1 circulates.

The refrigerant circulation line 3 for circulating a refrigerant such as Freon includes a refrigerant line 3*a* extending from an outlet of the compressor 2 to a four-way valve 5, a refrigerant line 3*b* extending from the four-way valve 5 to an outside heat-exchanger 6, a refrigerant line 3*c* extending from the outside heat-exchanger 6 to an inside heat-exchanger 9 via a linearly controlled expansion valve, i.e., a first expansion valve, a refrigerant line 3*d* extending from the inside heat-exchanger 9 to the four-way valve 5 via a refrigerant-heating element 7, a refrigerant line 3*e* extending from the four-way valve to an accumulator 10, and a refrigerant line 3*f* extending from the accumulator 10 to an inlet of the compressor 2. In the above, the accumulator 10 stores a liquid refrigerant and is used for preventing a liquid refrigerant from flowing into the compressor 2.

In the air conditioning apparatus, the refrigerant circulation line 3 comprises a bypass line 3*g* bypassing the linearly controlled expansion valve 8 and the inside heat-exchanger 9. The bypass line 3 is provided with a linearly controlled expansion valve 11, i.e., a second expansion valve. The refrigerant-heating element 7 is disposed between the linearly controlled expansion valve 11 and the four-way valve 5.

The cooling water line 4 for circulating with a water pump 12 a cooling water for cooling the engine 11 includes a cooling water line 4*a* extending from an outlet of the water pump 12 to a cooling water inlet of the engine 1 via an exhaust gas heat-exchanger 13, a cooling water line 4*b* extending from a cooling water outlet of the engine 1 to the refrigerant-heating element 7, and a cooling water line 4*c* extending from the refrigerant-heating element 7 to an inlet of the water pump 12.

Heating Mode

Operation in a heating mode according to the present invention will be explained with reference to the p-i chart depicted in FIG. 4.

Figure 4:
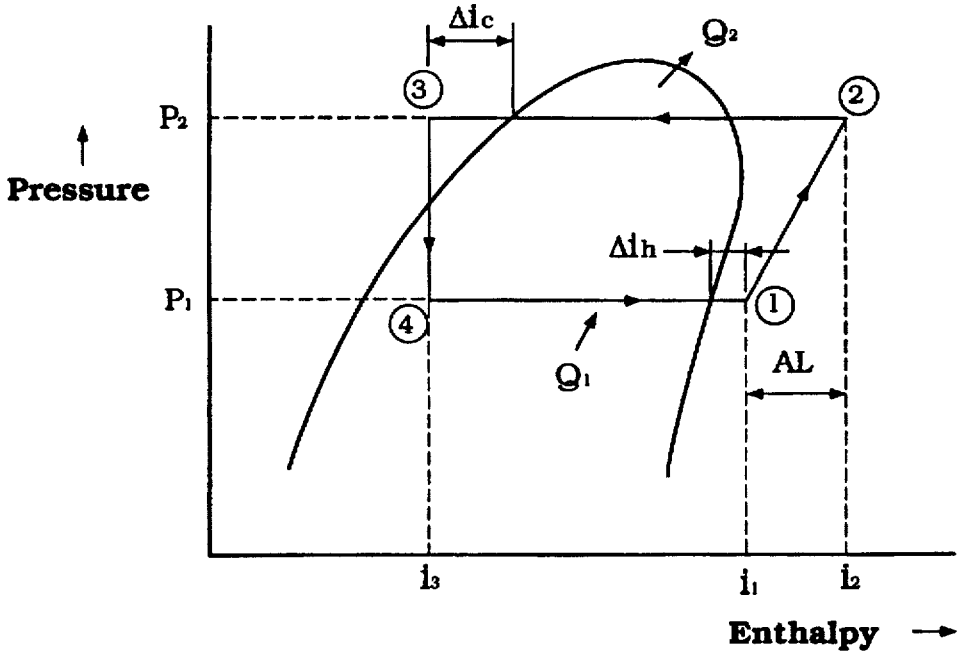
FIG. 4 is a p-i chart showing changes in pressure and enthalpy of a refrigerant in a heating or cooling cycle.

When the compressor 2 is driven by the engine 1, the vaporized refrigerant in a state marked (1) in FIG. 4 (pressure $P_1$ and enthalpy $i_1$) is introduced into the compressor 2 from the refrigerant circulation line 3*f*, compressed, and changed to a state marked (2) in FIG. 4 (pressure $P_2$ and enthalpy $i_2$) in which the refrigerant has a high temperature and is under a high pressure. The necessary power of the compressor 2 per unit weight of the refrigerant, AL, is expressed as $(i_2-i_1)$.

The above vaporized refrigerant with a high temperature and under a high pressure is moved to the four-way valve 5 through the refrigerant line 3*a*. In a heating mode, port "a" and port "c" of the four-way valve 5 are communicated with port "b" and port "d", respectively. The linearly controlled expansion valve 11 installed in the bypass line 3*a* is entirely closed while the linearly controlled expansion valve 8 is opened and set at an appropriate angle of opening. The vaporized refrigerant with a high temperature and under a high pressure flows into the refrigerant line 3*d* via the four-way valve 5 and the refrigerant-heating element 7, and is introduced into the inside heat-exchanger 9 functioning as a condenser.

The vaporized refrigerant with a high temperature and under a high pressure introduced into the inside heat-exchanger 9 is liquefied while radiating heat of condensation $Q_2$ to the air in a room, and sub-cooled to a state marked (3) in FIG. 4 (pressure $P_2$ and enthalpy $i_3$) so as to liquefy the refrigerant, thereby heating the room using heat of radiation $Q_2$.

The refrigerant under a high pressure liquefied at the inside heat-exchanger 9 undergoes drastic reduction of pressure by the linearly controlled expansion valve 8, and is changed to a state marked (4) in FIG. 4 (pressure $P_1$ and enthalpy $i_3$), in which part of the refrigerant is vaporized and the vapor-liquid refrigerant flows in the refrigerant line 3*c* towards the outside heat-exchanger 6. This refrigerant, with a low temperature and under a low pressure, flowing in the refrigerant line 3*c* reaches the outside heat-exchanger 6 functioning as an evaporator, and is vaporized while absorbing heat of evaporation from the outside air. The refrigerant moves from the outside heat-exchanger 6 to the four-way valve 5 through the refrigerant line 3*b*, in which port "c" and port "d" of the four-way valve 5 are communicated with each other in a heating mode, thereby leading the refrigerant to the refrigerant line 3*e* via the four-way valve 5, and reaching the accumulator 10.

In the accumulator 10, the vapor-liquid refrigerant is separated into the vapor refrigerant and the liquid refrigerant. The vapor refrigerant is introduced to the compressor 2 through the refrigerant line 3*f*. The state of the vapor refrigerant is returned to a state marked (1) in FIG. 4 (pressure $P_1$ and enthalpy $i_1$), and the vapor refrigerant is again compressed by the compressor 2, thereby repeating the same operation as described above.

The refrigerant absorbs heat, to vaporize and to be further superheated, from the outside air in the outside heat-exchanger 6 upon reduction of the pressure, and additionaly from the lubricating oil circulating through the engine and the accumulator (not shown), resulting in receipt of heat $Q_1$ ($=i_1-i_3$) between the outlet of the linearly controlled expansion valve 8 and the inlet of the compressor 2.

Meanwhile, a cooling water circulating in the cooling water line 4 by operation of the water pump 12 is pushed out from the water pump 12, flows in the cooling water line 4*a*, absorbs heat from exhaust gas discharged from the engine 1, and further absorbs heat from the engine 1 via a water-cooled jacket 1*a*, thereby cooling the engine while absorbing heat. The cooling water used for cooling the engine 1 flows in the cooling water line 4*b*, goes to a radiator 25 via a three-way valve 53, thereby cooling the water, and is introduced to the water pump 12. In a heating mode, in order to enhance radiated heat in the room, if the temperature of the refrigerant passing through the refrigerant line 3*d* is lower than the temperature of the cooling water circulating the cooling water line 4*b*, the cooling water is permitted to flow into the refrigerant-heating element 7 by changing the three-way valve 53 to lead the cooling water to the refrigerant-heating element 7, not to the radiator 25. The cooling water exchanging heat with the refrigerant in the refrigerant-heating element 7 is returned to the water pump 12 through the cooling water line 4*c*, and circulates in the same manner. If the temperature of the refrigerant passing through the refrigerant line 3*d* is higher than the temperature of the cooling water circulating the cooling water line 4*b*, the cooling water circulates through the radiator 25 and bypasses the refrigerant-heating element 7.

Defrosting Mode

In the heating mode, the refrigerant, which has passed through the linearly controlled expansion valve 8 and undergone drastic reduction of pressure, vaporizes and exchanges heat with the outside air in the outside heat-exchanger 6, whereby moisture contained in the outside air is condensed and frozen on the endothermic fins of the outside heat-exchanger 6. If the fins are frosted, the defrosting of reversing type is conducted in a defrosting mode, i.e., in a temporary cooling mode, in which the outside heat-exchanger 6 temporarily functions as a condenser and is heated by heat of condensation radiated from the refrigerant in the outside heat-exchanger 6, thereby defrosting the fins.

In the defrosting mode, the four-way valve 5 is turned in such a way that port "a" and port "b" thereof are communicated with port "c" and port "d", respectively, and the second expansion valve, i.e., the other linearly controlled expansion valve 11, is opened while the first expansion valve, i.e., the linearly controlled expansion valve 8, is partially or entirely closed. Accordingly, the refringent with a high temperature and under a high pressure, which flows in the refrigerant line 3*a* after the outlet of the compressor 2, is led to the outside heat-exchanger 6 functioning as a condenser via the four-way valve 5 and through the refringent line 3*b*. The vaporized refringent with a high temperature and under a high pressure is led to the outside heat-exchanger 6, radiates heat of condensation and melts the frost on the endothermic fins.

All of or most of the liquefied refrigerant under a high pressure used for defrosting the outside heat-exchanger 6 flows in the bypass line 3*g*, undergoes reduction of pressure by the linearly controlled expansion valve 11 (the second expansion valve), thereby vaporizing part of the refrigerant and leading the refrigerant to the refrigerant-heating element 7 through the refrigerant line 3*d*. The exhaust heat from the engine 1 is exerted on the refrigerant having a low temperature (flowing in the refrigerant line 3*d*) in the refrigerant-heating element 7, in which the refrigerant receiving the exhaust heat is completely vaporized. After this, the refrigerant is superheated, and led to the accumulator 10 via the four-way valve 5 and through the refrigerant line 3*e*. Meanwhile, the cooling water absorbing heat from the engine circulates through the refrigerant-heating element 7, not through the radiator 25, in which the three-way valve 53 has been turned so as to lead the cooling water to the refrigerant-heating element.

The vaporized refrigerant is separated from the liquefied refrigerant, and the vaporized refrigerant is introduced into the compressor 2 through the refrigerant line 3*f*, in which the vaporized refrigerant is again compressed by the compressor 2, and the same operation as describe above is repeated.

In the above defrosting mode, heat of condensation is radiated in the outside heat-exchanger 6 functioning as a condenser, thereby liquefying the refrigerant, but the flow of the refrigerant is reduced in or stopped from flowing into the inside heat-exchanger 9. Thus, cool air from the inside heat-exchanger 9 does not blow, so that occupants of the room to be heated do not experience discomfort.

Further, the liquefied refrigerant with a low temperature and under a low pressure upon the linearly controlled expansion valve 11 is heated in the refrigerant-heating element 7, and completely vaporized so as to turn into the vaporized refrigerant, thereby avoiding a liquid return to the compressor 2 and eliminating a cause of a breakdown of the compressor 2.

The ratio of refrigerant passing through the expansion valve 11 (the second expansion valve) to that passing through the expansion valve 8 (the first expansion valve) is adjusted so as to satisfy the following conditions: (a) cool air is not generated in a room to an uncomfortable level; and (b) the amount of the vaporized refrigerant is sufficient to operate the apparatus (the liquefied refringent does not flow into the compressor). Depending on the quantity of heat exerted on the refrigerant, part of the refrigerant may be introduced to the first expansion valve and the inside heat-exchanger: otherwise, liquid refrigerant remains and causes a breakdown of the compressor. The ratio is linearly controlled by manipulating the first expansion valve (partially or entirely closed) and the second expansion valve (partially or entirely opened). The expansion valve can be a linearly controlled expansion valve or composed of an on-off valve and an orifice.

Although the refrigerant-heating element 7 is formed of a heat-exchanger of double tube type for exchanging heat between the engine cooling water and the refrigerant in this embodiment, the refrigerant-heating element can be formed of an accumulator similar to the accumulator 10 provided with a channel through which the cooling water passes. The refrigerant-heating element can be disposed at various positions downstream of the expansion valve 11 and upstream of the compressor 2, such as in the bypass line 3*g*, in the refrigerant line 3*e*, in the refrigerant line 3*f*, and inside the accumulator 10. If the refrigerant-heating element is disposed in the refrigerant line 3*e* or 3*f* or in the accumulator 10 as shown in FIG. 1, the element can be used not only in a defrosting mode but also in a heating mode (i.e., upstream of the compressor). The refrigerant in the refrigerant line 3*f* is in a vapor state, not in a vapor-liquid mixture state, and thus the refrigerant-heating element is preferably disposed upstream of the accumulator 10 so that heat from the refrigerant-heating element can be exerted on the entire refrigerant (vapor-liquid mixture).

Cooling Mode

The air conditioning apparatus can be used as an air conditioner fox cooling a room by reversing the flow of the refrigerant, i.e., manipulating the four-way valve 5. In a cooling mode, when the outside temperature is low, i.e., condensation capacity is larger than evaporation capacity, in order to compensate for heat of evaporation in the room, the refrigerant-heating element can be effectively used, thereby preventing a liquid return to an inlet of the compressor.

Electrically-driven Compressor Type

An electrically-driven compressor can be substituted for an engine-driven compressor described above.

Figure 3:
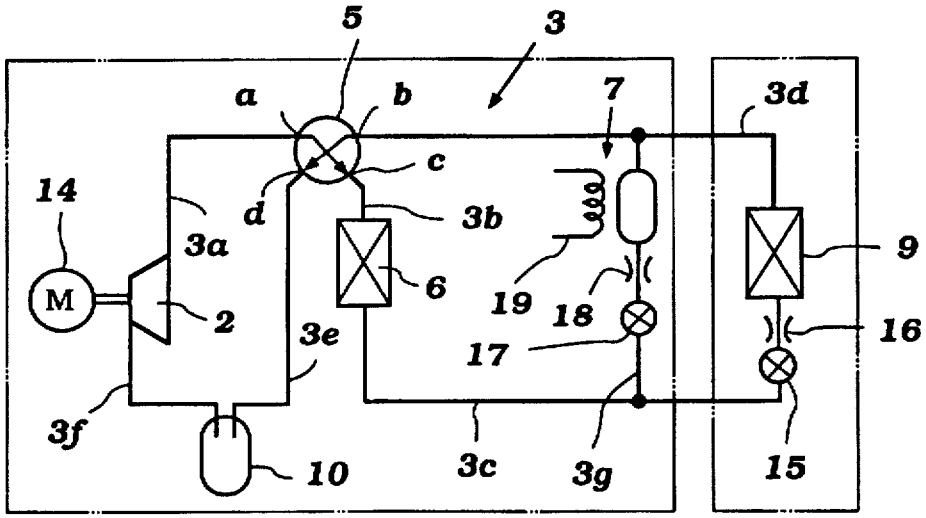
FIG. 3 is a schematic circuit illustrating basic structures of an electrically driven air conditioning apparatus according to another embodiment of the present invention.

FIG. 3 is a schematic circuit illustrating basic structures of an electrically driven air conditioning apparatus according to another embodiment of the present invention. In FIG. 3, the elements marked the same numerals as in FIG. 1 are the same elements as in FIG. 1.

As contrasted with the system depicted in FIG. 1, in this embodiment, an electrically-driven motor 14 is used as a drive for the compressor 2, the first expansion valve is composed of an on-off valve 15 and an orifice 16, the second expansion valve is composed of an on-off valve 17 and an orifice 18, the refrigerant-heating element 7 is formed of an electric heater 19, and the electric heater 19 is disposed in the bypass line 3*g*. The remaining elements in FIG. 3 are the same as in FIG. 1.

In a defrosting mode, the four-way valve 5 is switched so as to communicate port "a" and port "c", and port "b" and port "d", in which the on-off valve 17 is opened while the other on-off valve 15 is partially or completely closed. Accordingly, the refrigerant with a high temperature and under a high pressure, which is flowing in the refrigerant line 3*a* after the compressor 2, is led to the outside heat-exchanger 6 functioning as a condenser via the four-way valve through the refrigerant line 3*b*. The vaporized refrigerant with a high temperature and under a high pressure radiates heat of condensation in the outside heat-exchanger 6, thereby melting frost formed on endothermic fins and removing it.

All or most of the liquefied refrigerant under a high pressure, which has been used for defrosting the outside heat-exchanger 6, flows into the bypass line 3*g*, partially vaporizes due to drastic reduction of pressure upon the on-off valve 17 and the orifice 18, and flows into the refrigerant-heating element 7 through the refrigerant line 3*d*. The refrigerant, which is flowing in the refrigerant line 3*d*, is heated, vaporized and superheated by the electric heater 19 at the refrigerant-heating element 7, and flows into the refrigerant line 3*e* via the four-way valve 5. The refrigerant is then led to the accumulator 10, in which the vapor and liquid are separated, and the vaporous refrigerant is again compressed by the compressor 2. The operation is repeated in the same manner.

In the above defrosting operation, the refrigerant, which has been liquefied by radiating heat of condensation in the outside heat-exchanger 6 functioning as a condenser, is partially or completely restrained from flowing into the inside heat-exchanger 9, thereby preventing cool air from coming out from the inside heat-exchanger 9 and accordingly eliminating discomfort to occupants. Further, the refrigerant, which has been liquefied by passing through the on-off valve 17 and the orifice 18 due to drastic reduction of pressure, is completely vaporized by heat from the refrigerant-heating element 7, thereby preventing a liquid return to the compressor 2 and accordingly eliminating a cause of a breakdown of the compressor 2.

The defrosting operation can be automated in such a way that the four-way valve is automatically switched so as to connect the high pressure side of the compressor to the outside heat-exchanger, partially or completely close the first expansion valve, and open the second expansion valve.

Figure 5:
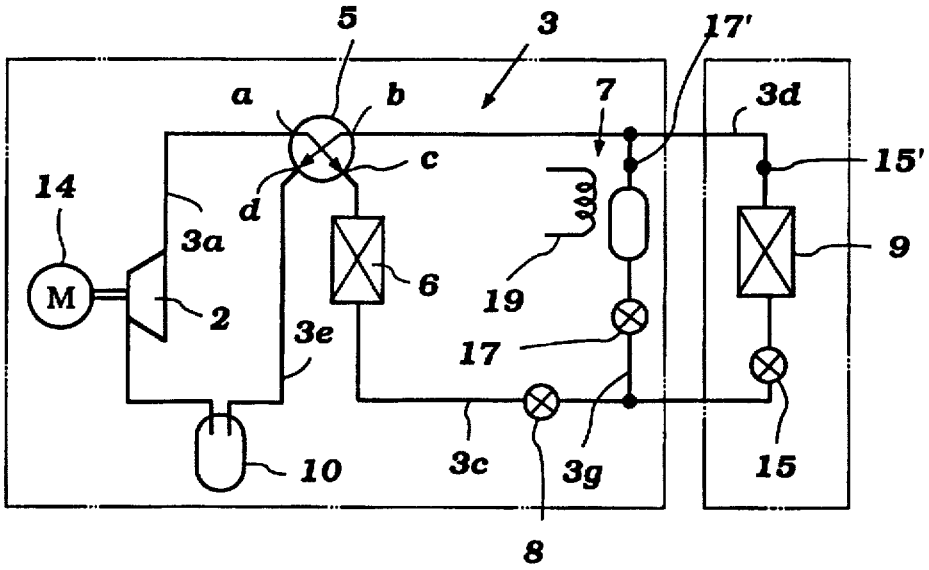
FIG. 5 is a schematic circuit illustrating basic structures of an electrically driven air conditioning apparatus according to another embodiment of the present invention.

FIG. 5 is a schematic circuit illustrating basic structures of an electrically driven air conditioning apparatus according to another embodiment of the present invention. In FIG. 5, the elements marked the same numerals as in FIGS. 1 and 3 are the same elements as in FIGS. 1 and 3. In this embodiment, the apparatus is provided with one expansion valve 8 in the refrigerant line 3*c*, and on-off valves 15 and 17 in the refrigerant lines 3*d* and 3*g*, respectively. In the defrosting mode, the on-off valve 15 is closed while the on-off valve 17 is open. In the cooling and heating modes, the on-off valve 15 is open while the on-off valve 17 is closed. The on-off valve 15 can be provided at another position in the refrigerant line 3*d*, e.g., downstream of the inside heat-exchanger 9 in the defrosting mode (marked 15' in the Figure). The on-off valve 17 can also be provided at another position in the refrigerant line 3*g*, e.g., downstream of the refrigerant-heating element 7 in the defrosting mode (marked 17' in the Figure). The refrigerant-heating element 7 can be installed at a position other than in the refrigerant line 3*g*, e.g., between the compressor 2 and the point of convergence of the refrigerant lines 3*d* and 3*g* when in defrosting mode. The bypass line or the refrigerant line 3*g* downstream of the refrigerant-heating element 7 can also be connected to the refrigerant line 3*d* or 3*e*.

Figure 6:
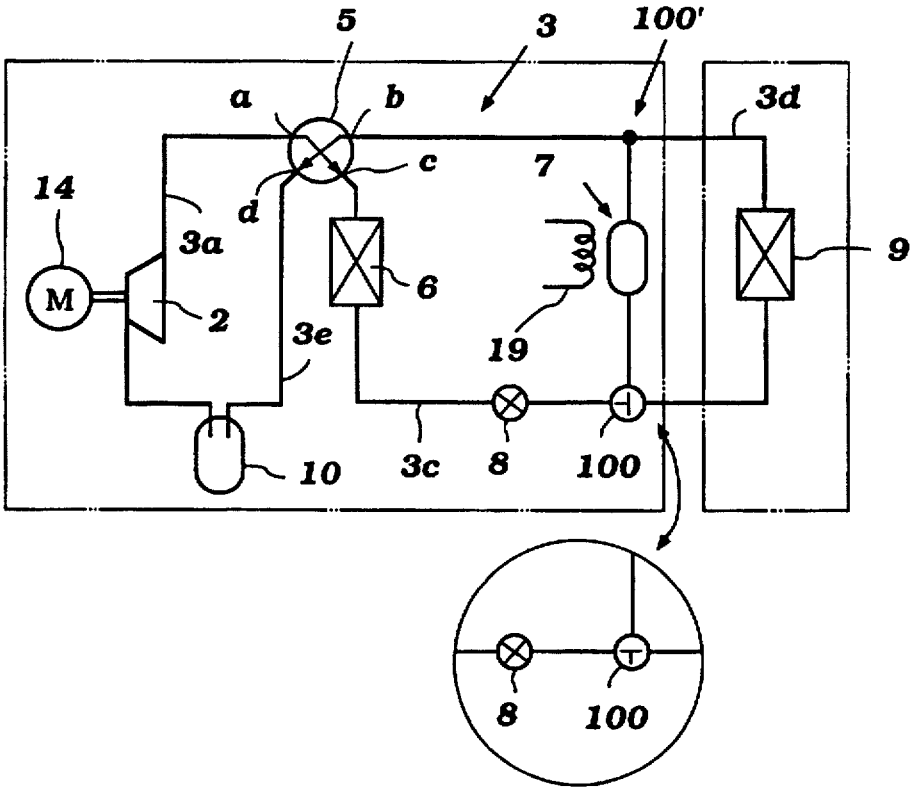
FIG. 6 is a schematic circuit illustrating basic structures of an electrically driven air conditioning apparatus according to another embodiment of the present invention.

FIG. 6 is a schematic circuit illustrating basic structures of an electrically driven air conditioning apparatus according to another embodiment of the present invention. In FIG. 6, the elements marked the same numerals as in FIGS. 1 and 3 are the same elements as in FIGS. 1 and 3. In this embodiment, the apparatus is provided with one expansion valve 8 in the refrigerant line 3*c*, and a three-way valve 100 at the point of divergence of the refrigerant lines 3*d* and 3*g* when in the defrosting mode. By the three-way valve 100, the refrigerant flows into the refrigerant-heating element 7, not into the inside heat-exchanger 9, when in the defrosting mode. The three-way valve 100 indicated in the circle of FIG. 6 shows the setting of the three-way valve when in the cooling and heating modes, whereby the refrigerant flows into the inside heat-exchanger 9, not into the refrigerant-heating element 7. The three-way valve 100 can be provided at the point of convergence of the refrigerant lines 3*d* and 3*g* when in the defrosting mode. The bypass line or the refrigerant line 3*g* downstream of the refrigerant-heating element 7 can also be connected to the refrigerant line 3*d* or 3*e*.

The embodiments in connection with the control valves shown in FIGS. 5 and 6 can be adapted to an engine-driven heat pump apparatus.

EXAMPLE: Air Conditioning Apparatus with Engine-driven Compressor

Figure 2:
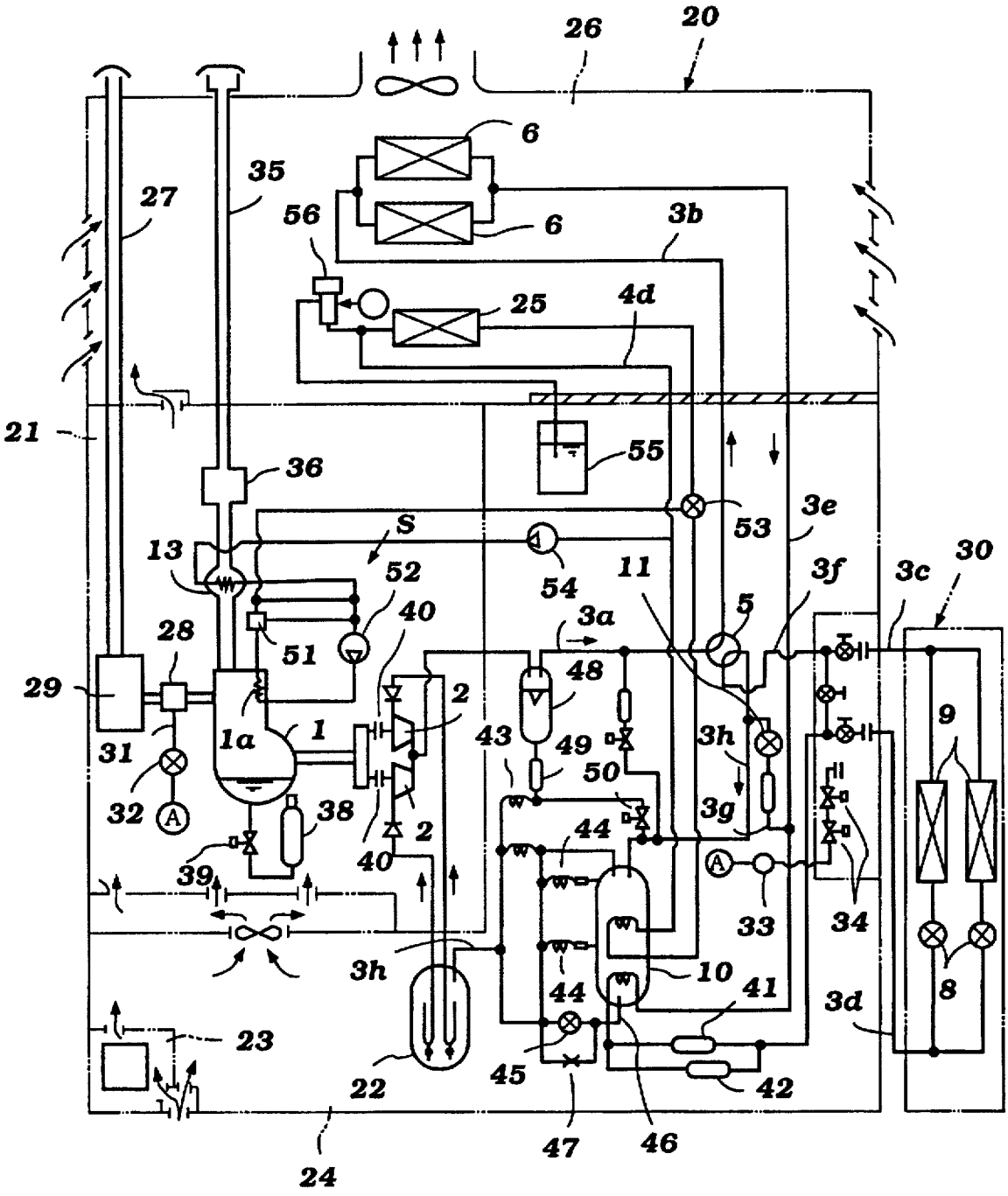
FIG. 2 is a schematic circuit illustrating actual structures of the engine-driven air conditioning apparatus (actual model) according to an embodiment of the present invention.

FIG. 2 is a schematic circuit illustrating actual structures of the engine-driven air conditioning apparatus (actual model) according to an embodiment of the present invention.

The air conditioning apparatus depicted in FIG. 2 comprises an outside unit 20 and an inside unit 30, and the latter comprises an inside heat-exchanger 9 and a first expansion valve 8. The outside unit 20 includes an engine room 21 comprising an engine 1 and a compressor 2, a piping room 24 comprising a main accumulator 10, a sub-accumulator 22, an electric parts room 23, and piping connecting each refrigerant device, and an outside heat-exchanger room 26 comprising an outside heat-exchanger 6 and a radiator 25.

The engine 1 is a water-cooled gas engine and its intake port connects an air-fuel gas mixer 28 and an air cleaner 29 via an intake air pipe 27. The intake air pipe 27 is open to the outside through ceiling walls of the engine room 21 and the outside heat-exchanger room 26.

The air-fuel gas mixer 28 connects a fuel gas source (not shown) via a fuel gas supplying pipe 31 which is equipped with a fuel gas flowing amount control valve 32 integrated with the air-fuel gas mixer 28, a fuel gas pressure reducer (for regulating the pressure of supplied fuel gas) 33, and two fuel gas source valves 34 (electromagnetic valve). An exhaust port of the engine 1 connects an exhaust gas heat-exchanger (muffler) 13, an exhaust silencer 36, and a mist separator 37. An exhaust pipe 35 is open through the upper part of the outside heat-exchanger room 26. The engine 1 is provided with a replenishing oil control valve 38 so that lubricant oil is supplied to the engine 1 by gravity after a replenishing oil control valve 39 is opened when the lubricant oil level is low.

The driving shaft of the engine 1 connects the compressor 2 via electric magnetic clutches 40. The outlet of the compressor 2 connects the outside heat-exchanger 6 via the refrigerant line 3*a*, the four-way valve 5 and the refrigerant line 3*b*. The outside heat-exchanger 6 connects the inside heat-exchanger 9 via the refrigerant line 3*e*, joints, heat-exchanging parts inside the accumulator 10, and the refrigerant line 3*d*. The inside heat-exchanger 9 connects the inlet of the compressor 2 via the refrigerant line 3*c*, joints, the refrigerant line 3*f*, the four-way valve 5, the main accumulator 10 upstream of the refrigerant line 3*h*, and the sub-accumulator 22.

In addition, a dryer 41 is provided in the refrigerant line 3*e*, and a strainer 42 is arranged in parallel to the dryer 41. A capillary tube 43 and a combination of a capillary tube and a temperature sensor 44 are installed. The latter is for detecting the refrigerant level in the main accumulator 10 by detecting the temperature of the refrigerant. An electric magnetic valve 45, an oil return line 46, and an orifice 47 are installed for guiding lubricant oil from the main accumulator 10 to the sub-accumulator 22 by manually or automatically opening the electric magnetic valve 45 when the amount of lubricant oil remaining at the bottom of the main accumulator 10 is increased.

An oil separator 48 is installed for separating lubricant oil contained in the refrigerant in the refrigerant line 3*a*. The lubricant oil separated by the oil separator 48 is continuously returned to the refrigerant line 3*h* via the capillary tube 43, and returned further to the sub-accumulator 49 via the main accumulator 10 through an oil strainer 49 and an electric magnetic valve 50 when the amount of lubricant oil is higher than a given level. The refrigerant line 3*a* connects the main accumulator 10 via the oil strainer 49 and the electric magnetic valve 50 which is opened when the pressure of the refrigerant is higher than a given level, thereby preventing an irregularly high pressure in the refrigerant circulation line (in the high pressure line).

In addition to the refrigerant circulation line, the outside unit 20 is equipped with a cooling water circulation system S. The cooling water circulation system S includes a first cycle, a second cycle, and a third cycle. In the first cycle, cooling water circulates through a water jacket 1*a* in the engine 1, a thermostat 51, and a water pump 52 when the temperature of cooling water is lower than a given level, i.e., the engine is cool. In the second cycle, cooling water circulates through the exhaust gas heat-exchanger 13 (muffler), the three-way valve 53 (for linearly changing the flow ratio between two directions), the radiator 25, and a water pump 54 when the temperature of cooling water is higher than a given level, i.e., the engine is warm. In the third cycle, cooling water circulates through the exhaust gas heat-exchanger 13, the three-way valve 53, the heat-exchanger placed inside the main accumulator 10, and the water pump 54 when the temperature of cooling water is higher than a given level, i.e., the engine is warm. The third cycle is for heating the refrigerant in the refrigerant circulation line in a defrosting mode, a heating mode or a cooling mode. When the refrigerant need not be heated, the second cycle is operated. The three-way valve 53 is a linearly controlled valve so that tile ratio of the flow of the second cycle to the flow of the third cycle can be freely adjusted.

The radiator 25 connects a water reservoir tank 55 for cooling water via a water pouring hole cap 56 which is connected to one port of the thermostat 51, thereby allowing for addition of water from the reservoir tank 55 to the cooling water line and for lease of air from the cooling water line. A port of the thermostat 51 is continuously communicated with the water jacket 1 of the engine 1, thereby allowing for leasing air from the cooling water line of the first cycle.

By manipulating the three-way valve 53, cooling water is introduced to the heat-exchanger in the main accumulator 10 through the cooling water line 4d, thereby heating the refrigerant.

The bypass line 3*g* for bypassing the first expansion valve 8 and the inside heat-exchanger 9 is also installed as shown in FIG. 1. The second expansion valve 11 is provided in the bypass line 3*g*. As contrasted with the system depicted in FIG. 1, the main accumulator 10 functions as the refrigerant-heating element in this embodiment.

As described in connection with the system depicted in FIG. 1, in a defrost mode, the outside heat-exchanger 6 temporarily functions as a condenser (temporarily in a cooling mode), thereby defrosting the outside heat-exchanger 6 with heat of radiation from the refrigerant. In the defrost mode, the four-way valve 5 is switched so as to reverse the flow of the refrigerant, the second expansion valve is opened while the first expansion valve is partially or completely closed. That is, the refrigerant with a high temperature and under a high pressure, which is flowing in the refrigerant line 3*a* after coming out from the outlet of the compressor 2, is led to the outside heat-exchanger 6 functioning as an evaporator via the four-way valve 5 through the refrigerant line 3*b*. The refrigerant with a high temperature and under a high pressure radiates heat of condensation in the outside heat-exchanger 6, thereby melting frost formed on the endothermic fins and removing it.

The refrigerant which is used for defrosting the outside heat-exchanger 6 is liquefied, maintaining the high pressure. All or most of the liquefied refrigerant flows into the bypass line 3*g*, and undergoes drastic reduction of pressure by the second expansion valve 11, thereby vaporizing part of the refrigerant. The refrigerant then flows into the main accumulator 10 functioning as a refrigerant-heating element. In the main accumulator 10, the refrigerant having a low temperature receives exhaust heat, thereby completely vaporizing the refrigerant and further superheating the refrigerant. The superheated refrigerant is introduced to the sub-accumulator 22 in which the liquid portion of the refrigerant is separated and the vaporous portion is send to the compressor 2.

In the above defrosting operation, the refrigerant, which has been liquefied by radiating heat of condensation in the outside heat-exchanger 6 functioning as a condenser, is partially or completely restrained from flowing into the inside heat-exchanger 9, thereby preventing cool air from coming out from the inside heat-exchanger 9 and accordingly eliminating discomfort to occupants. Further, the refrigerant, which has been liquefied due to drastic reduction of pressure caused by passing through the expansion valve 11, is completely vaporized in the main accumulator 10 by absorbing exhaust heat from the engine, thereby preventing a liquid return to the compressor 2 and accordingly eliminating a cause of a breakdown of the compressor 2.

It will be understood by those of skill in the art that numerous variations and modifications can be made without departing from the spirit of the present invention. Therefore, it should be clearly understood that the forms of the present invention are illustrative only and are not intended to limit the scope of the present invention.

We claim:

1. An air conditioning apparatus comprising a refrigerant circulation line in which a refrigerant circulates, for heating or cooling the air in a room, said refrigerant circulation line comprising:

a compressor for circulating said refrigerant;

an inside heat-exchanger for exchanging heat between said refrigerant and the air inside a room;

an outside heat-exchanger for exchanging heat between said refrigerant and the air outside said room;

an expansion valve; and a four-way valve for reversing the flow of said refrigerant at said inside heat-exchanger and at said outside heat-exchanger, wherein said apparatus further comprises:

a bypass line for bypassing said inside heat-exchanger, said bypass line being disposed in parallel to said inside heat-exchanger;

at least one control valve disposed in said bypass line, for controlling the flow ratio of the refrigerant passing through said inside heat-exchanger and the refrigerant passing through said bypass line; and a refrigerant-heating element being disposed in a line downstream of said bypass line and upstream of said compressor when in the defrosting mode.

2. The air conditioning apparatus according to claim 1, wherein said at least one control valve is comprised of a second expansion valve provided in said bypass line.

3. The air conditioning apparatus according to claim 2, wherein said second expansion valve is a linearly controlled expansion valve or composed of an on-off valve and an orifice.

4. The air conditioning apparatus according to claim 1, wherein said expansion valve is a linearly controlled expansion valve or composed of an on-off valve and an orifice.

5. The air conditioning apparatus according to claim 1, wherein said compressor is an engine-driven compressor, and wherein said refrigerant-heating element is an accumulator or a heat-exchanger of double tube type through which a cooling water for cooling said engine and said refrigerant separately flow, in which heat from said cooling water is transmitted to said refrigerant.

6. The air conditioning apparatus according to claim 5, wherein said engine is provided with a water jacket and a muffler, in which said cooling water flows through said water jacket and said muffler to absorb heat therefrom.

7. The air conditioning apparatus according to claim 5, wherein a radiator is arranged in parallel to said refrigerant-heating element so as to allow for bypassing said refrigerant-heating element.

8. The air conditioning apparatus according to claim 1, wherein said refrigerant-heating element is disposed in a line downstream of said at least one control valve and upstream of said four-way valve when in the defrosting mode.

9. The air conditioning apparatus according to claim 5, wherein the accumulator is equipped with the refrigerant-heating element and is disposed downstream of the four-way valve and upstream of the compressor.

10. The air conditioning apparatus according to claim 9, wherein a line upstream of the expansion valve and downstream of the outside heat-exchanger when in the defrosting or cooling mode passes through the accumulator.

11. The air conditioning apparatus according to claim 9, further comprising a sub-accumulator disposed downstream of the accumulator.

12. A method for air-conditioning comprising the steps of:

circulating a refrigerant, for heating or cooling the air in a room, in a refrigerant circulation line comprising:

a compressor;

an inside heat-exchanger for exchanging heat between said refrigerant and the air inside said room;

an outside heat-exchanger for exchanging heat between said refrigerant and the air outside said room; an expansion valve; and a four-way valve for reversing the flow of said refrigerant at said inside heat-exchanger and at said outside heat-exchanger, wherein said refrigerant flows from said inside heat-exchanger to said outside heat-exchanger through said expansion valve for heating the air inside said room, and said refrigerant flows from said outside heat-exchanger to said inside heat-exchanger through said expansion valve for cooling the air inside said room;

when defrosting said outside heat-exchanger, setting with said four-way valve the flow of said refrigerant in the direction from said outside heat-exchanger to said inside heat-exchanger by circulating at least part of said refrigerant in a bypass line arranged in parallel to said inside heat-exchanger, said bypass line having therein at least one control valve wherein the flow ratio of the refrigerant passing through said inside heat-exchanger and the refrigerant passing through said bypass line is controlled by said at least one control valve; and heating said refrigerant upstream of said compressor and downstream of said bypass line when the refrigerant flows for defrosting, thereby defrosting said outside heat-exchanger substantially without cooling the air inside said room.

13. The method for air conditioning according to claim 12, wherein said at least one control valve is comprised of a second expansion valve provided in said bypass line, wherein the step of controlling the flow ratio comprises partially or entirely closing said expansion valve, and opening said second expansion valve.

14. The method for air conditioning according to claim 12, wherein said compressor is an engine-driven compressor, and wherein, when defrosting said outside heat-exchanger, said refrigerant is heated in an accumulator or a heat-exchanger of double tube type through which a cooling water for cooling said engine and said refrigerant separately flow, thereby transmitting heat from said cooling water to said refrigerant.

15. The method according to claim 14, wherein a radiator is arranged in parallel to said accumulator or said heat-exchanger of double tube type so as to bypass said accumulator or said heat-exchanger of double tube type when the cooling water does not have a temperature sufficient to heat said refrigerant.

16. The method for air conditioning according to claim 14, wherein said engine is provided with a water jacket and a muffler, in which said cooling water flows through said water jacket and said muffler to absorb heat therefrom.

17. The method for air conditioning according to claim 12, wherein, when defrosting said outside heat-exchanger, said refrigerant is heated between said at least one control valve and said four-way valve.

18. The method for air conditioning according to claim 14, wherein the refrigerant is heated in the accumulator which is disposed downstream of the four-way valve and upstream of the compressor.

19. The method for air conditioning according to claim 18, further comprising the step of heating the refrigerant upstream of the expansion valve and downstream of the outside heat-exchanger when in the defrosting or cooling mode, by passing the refrigerant through the accumulator.

20. The method for air conditioning according to claim 18, further comprising the step of passing the refrigerant through a sub-accumulator disposed downstream of the accumulator to further separate the liquid refrigerant.

* * * * *